US009388824B2

(12) United States Patent
Yin

(10) Patent No.: US 9,388,824 B2
(45) Date of Patent: Jul. 12, 2016

(54) SALT-SPRAY PROTECTION STRUCTURE FOR FAN

(75) Inventor: Guan-Chen Yin, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 689 days.

(21) Appl. No.: 13/299,675

(22) Filed: Nov. 18, 2011

(65) Prior Publication Data

US 2013/0129533 A1 May 23, 2013

(51) Int. Cl.

| | |
|---|---|
| ***F04D 29/32*** | (2006.01) |
| ***F04D 25/08*** | (2006.01) |
| ***F04D 29/08*** | (2006.01) |
| ***F04D 25/06*** | (2006.01) |

(52) U.S. Cl.

CPC ..... *F04D 29/329* (2013.01); *F04D 25/0646* (2013.01); *F04D 25/08* (2013.01); *F04D 29/083* (2013.01)

(58) Field of Classification Search

CPC ... F04D 29/646; F04D 29/661; F04D 29/663; F04D 29/666; F04D 29/667; F04D 29/668; F04D 29/023; F04D 29/321; F04D 29/329; F04D 29/642; F04D 25/062; F04D 25/013; F04D 25/0606; F04D 25/08; F04D 29/083; H02K 7/14; H02K 21/22; H02K 19/08; H02K 1/187

USPC ..... 417/423.4, 423.9, 423.14, 354

See application file for complete search history.

(56) References Cited

U.S. PATENT DOCUMENTS

| | | | | |
|---|---|---|---|---|
| 3,018,113 | A * | 1/1962 | Hall | F01D 11/025 277/413 |
| 6,616,422 | B2 * | 9/2003 | Hsieh | F04D 29/083 415/220 |
| 7,227,286 | B2 * | 6/2007 | Kudo et al. | 310/58 |
| 7,618,236 | B2 * | 11/2009 | Hsu | F04D 29/542 415/121.2 |
| 8,246,329 | B2 * | 8/2012 | Li | F04D 25/0613 310/63 |
| 9,057,380 | B2 * | 6/2015 | Lin | F04D 25/062 |
| 2002/0025261 | A1 * | 2/2002 | Kudo | F04D 25/0613 417/354 |
| 2006/0051221 | A1 * | 3/2006 | Chen | F04D 29/329 417/423.8 |
| 2009/0285699 | A1 * | 11/2009 | Muraoka | H02K 1/187 417/354 |
| 2011/0027075 | A1 * | 2/2011 | Nogami | F04D 25/0613 415/182.1 |

* cited by examiner

*Primary Examiner* — Bryan Lettman

(57) ABSTRACT

A salt-spray protection structure for fan includes a frame, a hub, at least one protruded portion, and a stator assembly. The frame is internally provided with a base that internally defines a receiving space and has a bearing cup and at least one raised end formed thereon. The hub is mounted on the base, and one side of the hub facing toward the base has at least one open end. The protruded portion is selectively formed on one of the raised end of the base and the open end of the hub. The stator assembly is fitted around the bearing cup. The protruded portion works to scrape off salt grains that are attached to and accumulated on the hub or the base, allowing the fan to have extended service life.

2 Claims, 10 Drawing Sheets

SALT-SPRAY PROTECTION STRUCTURE FOR FAN

FIELD OF THE INVENTION

The present invention relates to a salt-spray protection structure for fan, and more particularly to a salt-spray protection structure for fan that effectively scrapes off salt grains accumulated on the fan and accordingly, protects the fan against locking while enables the fan to have extended service life.

BACKGROUND OF THE INVENTION

A conventional cooling fan usually includes a fan frame, a bearing cup, a hub and a plurality of blades, a circuit board, and a stator assembly.

With the constantly widened applications in different fields thereof, the cooling fan has been used with many electronic devices with special purposes, such as central processing units (CPU), servers, power supplies, communication chassis, and telecommunication base stations. These electronic devices are also often used in very severe environments, such as humid, wet, and salt spray environments. Since general cooling fans, particularly the circuit board and bearing cup thereof, are not provided with any protective structure against water and salt spray, they are apparently not suitable for use in such severe environments. The circuit board and bearing cup inside the fan are subjected to corrosion by the salt spray accumulated thereon, and the corroded circuit board and bearing cup would lead to a stuck and immovable fan and shorten the service life of the fan.

To solve the above problem, a solution involving injection molding has been proposed. According to the injection molding solution, the stator assembly and the circuit board are first assembled to the fan frame to form a subassembly, and then, put the subassembly in a mold and inject a molding material into the mold. After the molding material is hardened, the subassembly is enclosed in the molding material and then removed from the mold. The molding material not only encloses the subassembly, but also fills up all internal spaces in between the stator assembly, the circuit board and the bearing cup, so as to provide the effect of water and salt spray resistance. However, since the molded injection material is thick, it would have adverse influence on the heat dissipation of the electronic components enclosed in the molding material to result in burned-out electronic components.

Further, the above-described injection molding solution is mainly used to protect the electronic components against short circuit and burnout due to corrosion caused by accumulated water and salt spray, and is not effective in terms of stopping the salt spray from accumulation. The main effect that can be achieved by the injection molding solution is water resistance. Further, the fan motor being enclosed in the injected molding material to protect the circuit board against water and salt spray has obviously reduced heat dissipation performance, which tends to result in an elevated temperature of the whole motor. Moreover, the salt spray accumulated in the fan motor enclosed in the injection molding material tends to form salt grains due to high temperature. The salt grains are attached to the interior of the fan to result in stuck fan and burned-out circuit board In brief, the conventional water and salt spray resistant structures for cooling fan have the following disadvantages:

(1) shortening the fan service life; (2) causing accumulated heat inside the fan; and (3) lowering the heat dissipation efficiency of the fan.

SUMMARY OF THE INVENTION

A primary object of the present invention is to provide a salt-spray protection structure for fan that effectively scrapes off salt grains accumulated on the fan.

To achieve the above and other objects, the salt-spray protection structure for fan according to the present invention includes a frame, a hub, at least one protruded portion, and a stator assembly. The frame is internally provided with a base that internally defines a receiving space and has a bearing cup and at least one raised end formed thereon. The hub is mounted on the base, and one side of the hub facing toward the base has at least one open end. The protruded portion is selectively formed on one of the raised end of the base and the open end of the hub. The stator assembly includes a plurality of silicon steel plates and is fitted around the bearing cup. The protruded portion works to scrape off extra salt grains that are attached to and accumulated on the open end of the hub or the raised end of the base, protecting the fan against locking and allowing the fan to have extended service life as well as enhanced interior heat dissipation efficiency.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
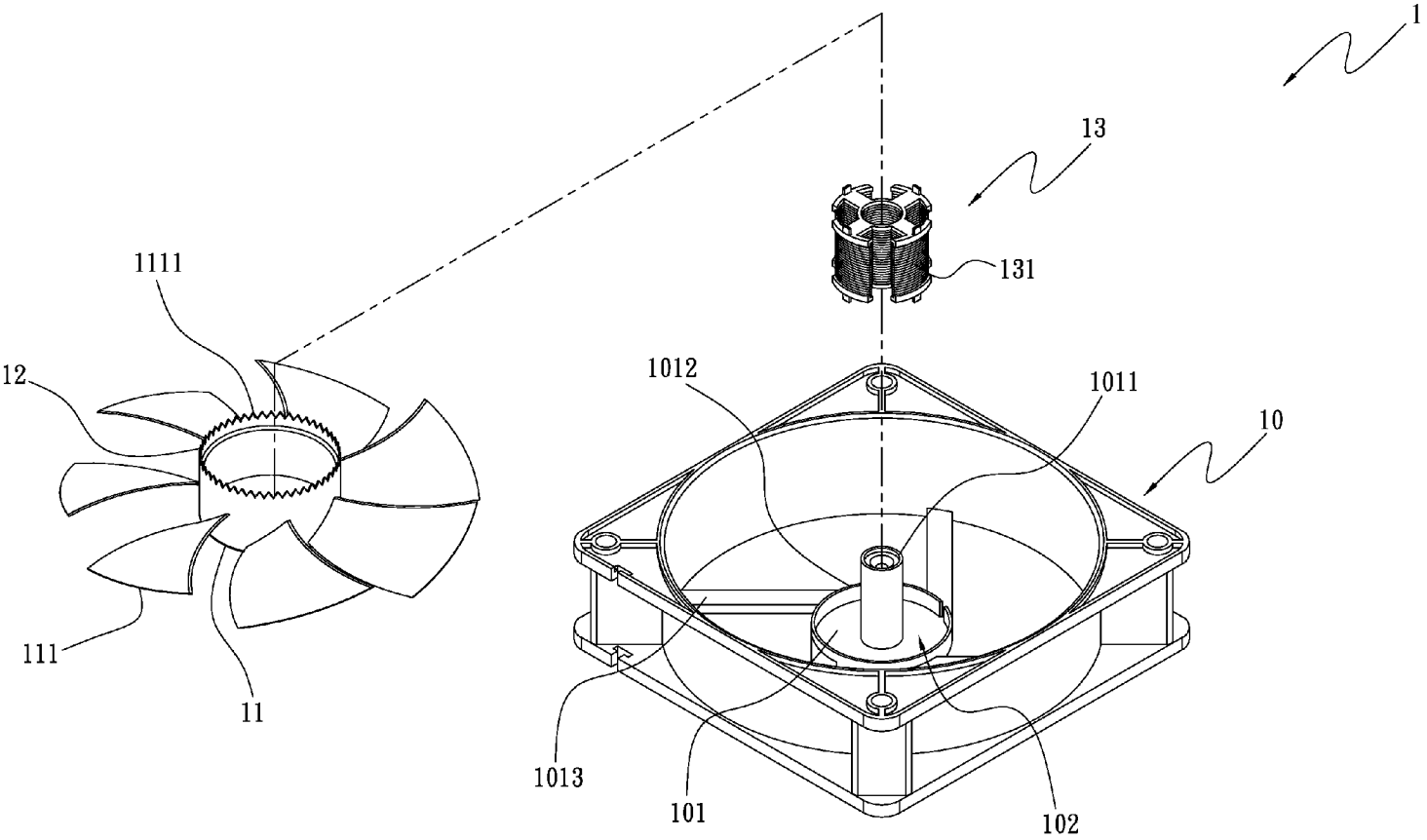
FIG. 1A is an exploded perspective view of a salt-spray protection structure for fan according to a first embodiment of the present invention.

The present invention will now be described with some preferred embodiments thereof and with reference to the accompanying drawings. For the purpose of easy to understand, elements that are the same in the preferred embodiments are denoted by the same reference numerals.

Figure 1B:
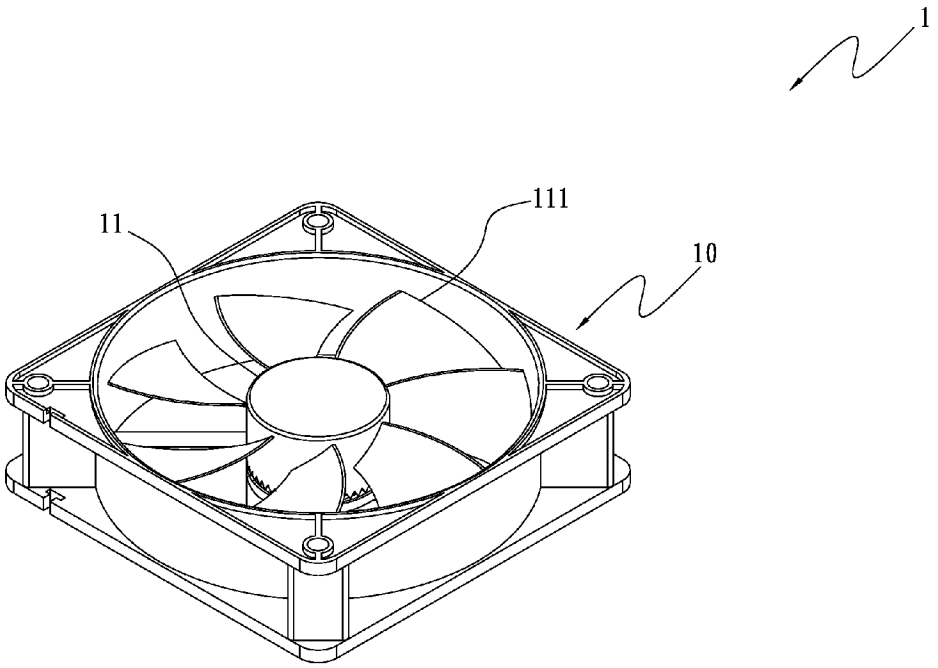
FIG. 1B is an assembled view of FIG. 1A.

Please refer to FIGS. 1A and 1B, which are exploded and assembled perspective views, respectively, of a salt-spray protection structure for fan according to a first embodiment of the present invention. As shown, in the first embodiment, the salt-spray protection structure for fan is generally denoted by reference numeral 1, and includes a frame 10, a hub 11, at least one protruded portion 12, and a stator assembly 13.

The frame 10 is internally provided with a base 101, which defines a receiving space 102 therein. On the base 101, there are formed a bearing cup 1011 and at least one raised end 1012. The base 101 is internally connected to the frame 10 via a plurality of supporting arms 1013. The hub 11 is mounted on the base 101. One side of the hub 11 facing toward the base 101 has at least one open end 1111. A plurality of blades 111 is externally provided on around the hub 11. The protruded portion 12 is a toothed body and can be formed on the open end 1111 of the hub 11 or on the raised end 1012 of the base 101. In the illustrated first embodiment as shown in FIGS. 1A and 1B, the protruded portion 12 is formed on the open end 1111 of the hub 11. The stator assembly 13 includes a plurality of silicon steel plates 131, and is fitted around the bearing cup 1011.

As can be seen in FIG. 1A, the protruded portion 12 is formed on the open end 1111 of the hub 11 and functions to scrape off salt grains that are attached to and accumulated on the raised end 1012, protecting the fan against locking and immovability caused by the accumulated salt grains. Therefore, the fan can have extended service life and enhanced interior heat dissipation efficiency.

Figure 2A:
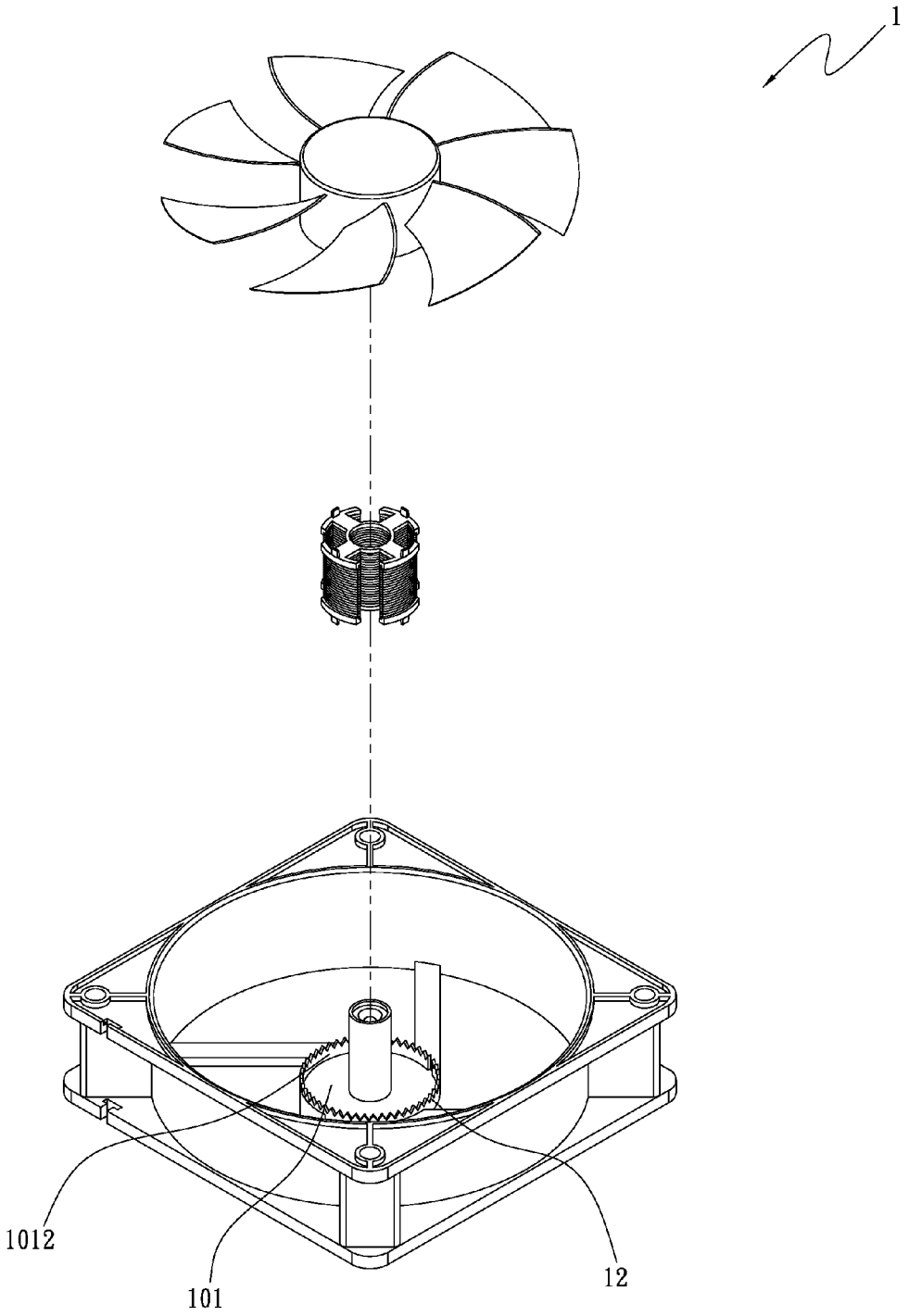
FIG. 2A is an exploded perspective view of a salt-spray protection structure for fan according to a second embodiment of the present invention.
Figure 2B:
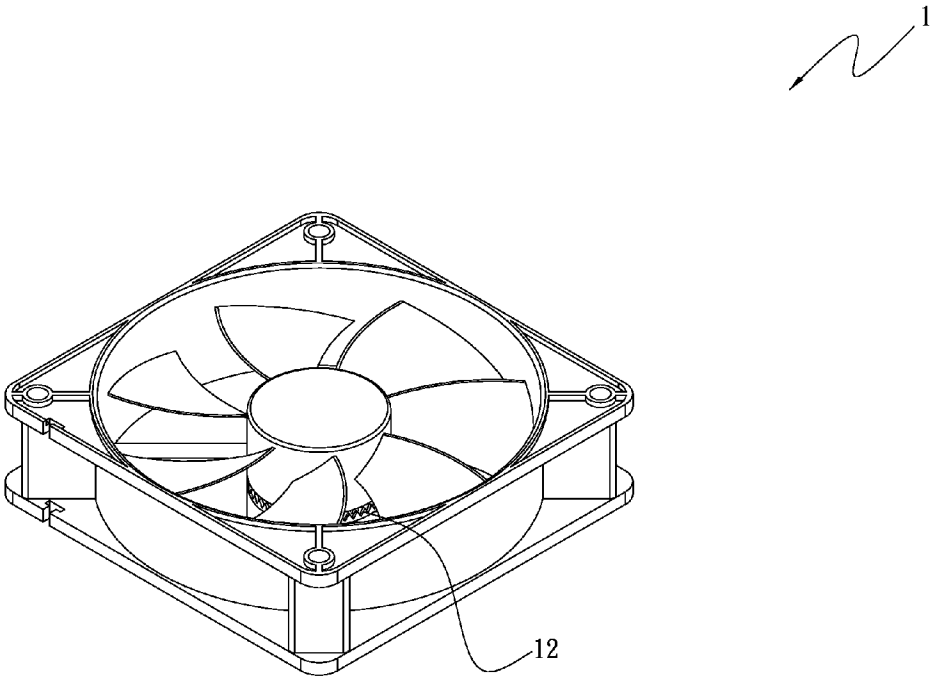
FIG. 2B is an assembled view of FIG. 2A.

FIGS. 2A and 2B are exploded and assembled perspective views, respectively, of a salt-spray protection structure for fan according to a second embodiment of the present invention. As shown, the second embodiment is generally structurally similar to the first embodiment, except that the protruded portion 12 is formed on the raised end 1012 of the base 101. With this arrangement, the protruded portion 12 can equally scrape off the salt grains attached to and accumulated on the open end 1111 of the hub 11 to thereby enable extended service life of the fan.

Figure 3A:
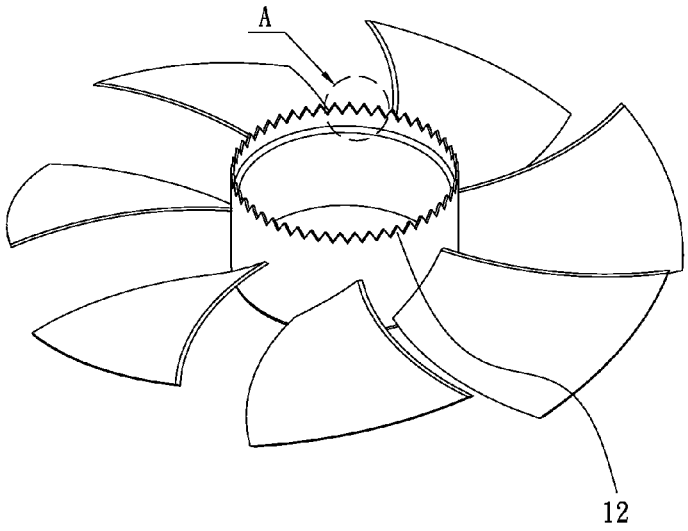
FIG. 3A is a perspective view showing a salt-spray protection structure for fan according to a third embodiment of the present invention.
Figure 3B:
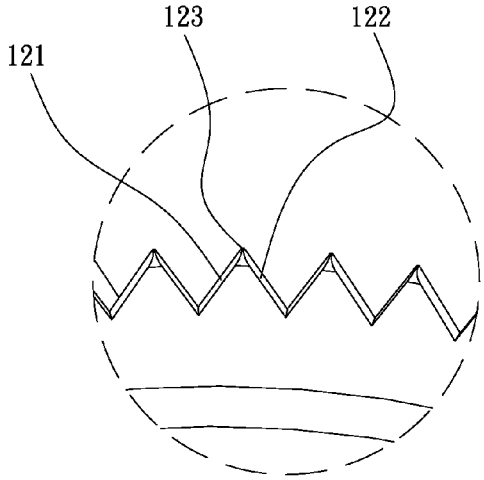
FIG. 3B is an enlarged view of the circled area A of FIG. 3A.

FIG. 3A shows a third embodiment of the salt-spray protection structure for fan according to the present invention, and FIG. 3B is an enlarged view of the circled area A of FIG. 3A. As shown, in the third embodiment, the protruded portion 12 includes a first slant surface 121, an opposite second slant surface 122, and a tip 123. Upper ends of the first and the second slant surface 121, 122 meet each other at the tip 123. During operation of the fan, the tip 123 works to scrape the undesired salt grains off the hub 11 and the base 101, so that the fan is not stuck due to the accumulated salt grains and can have extended service life.

Figure 4:
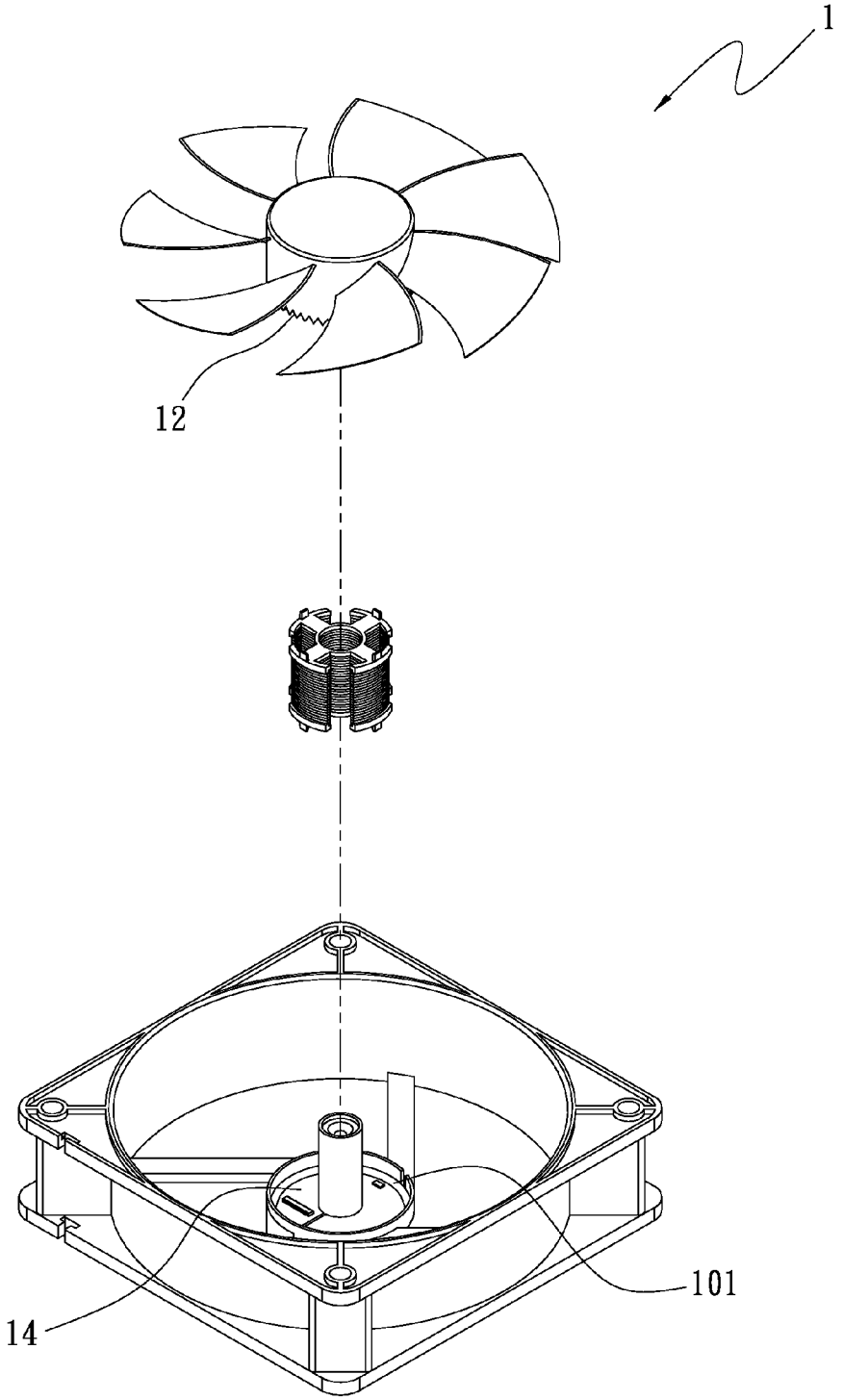
FIG. 4 is an exploded perspective view of a salt-spray protection structure for fan according to a fourth embodiment of the present invention.

FIG. 4 is an exploded perspective view of a salt-spray protection structure for fan according to a fourth embodiment of the present invention. As shown, in the fourth embodiment, the salt-spray protection structure for fan further includes a circuit board 14 mounted on the base 101, and the protruded portion 12 is provided on the open end of the hub to scrape off the undesired salt grains accumulated on the raised end 1012 of the base 101. With these arrangements, it is possible to reduce the accumulation of salt grains on the fan and accordingly the damage rate of the fan to thereby extend the service life of the fan.

Figure 5A:
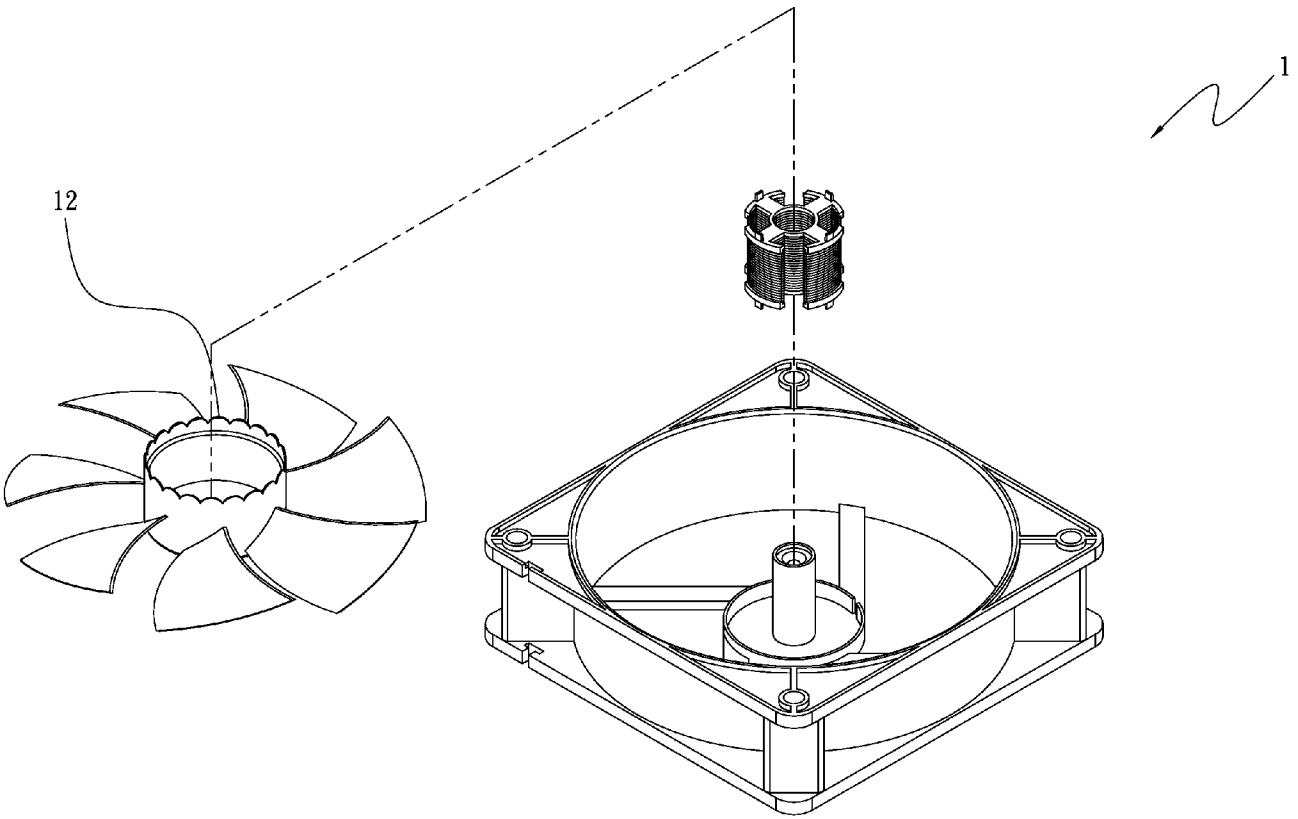
FIG. 5A is an exploded perspective view of a salt-spray protection structure for fan according to a fifth embodiment of the present invention.
Figure 5B:
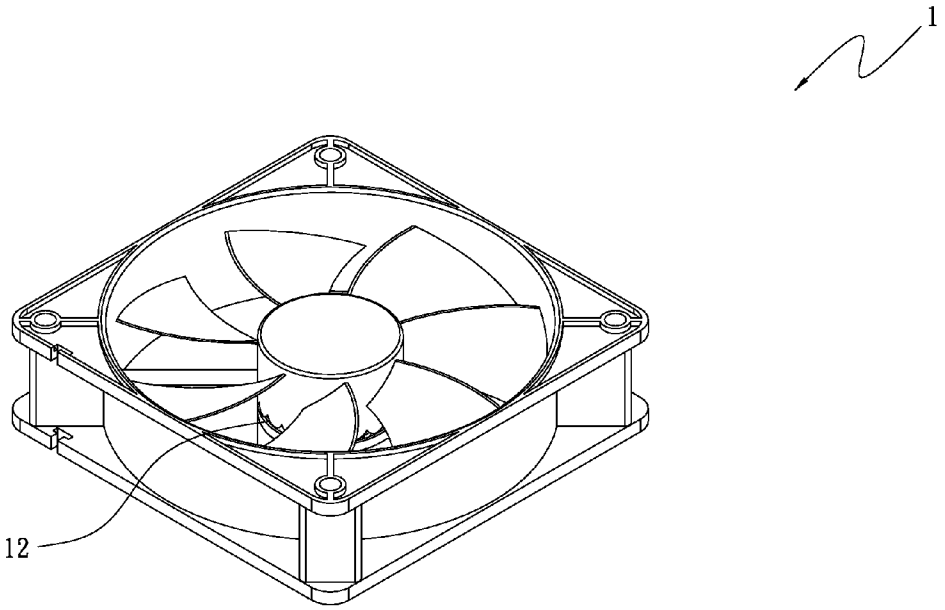
FIG. 5B is an assembled view of FIG. 5A.
Figure 6A:
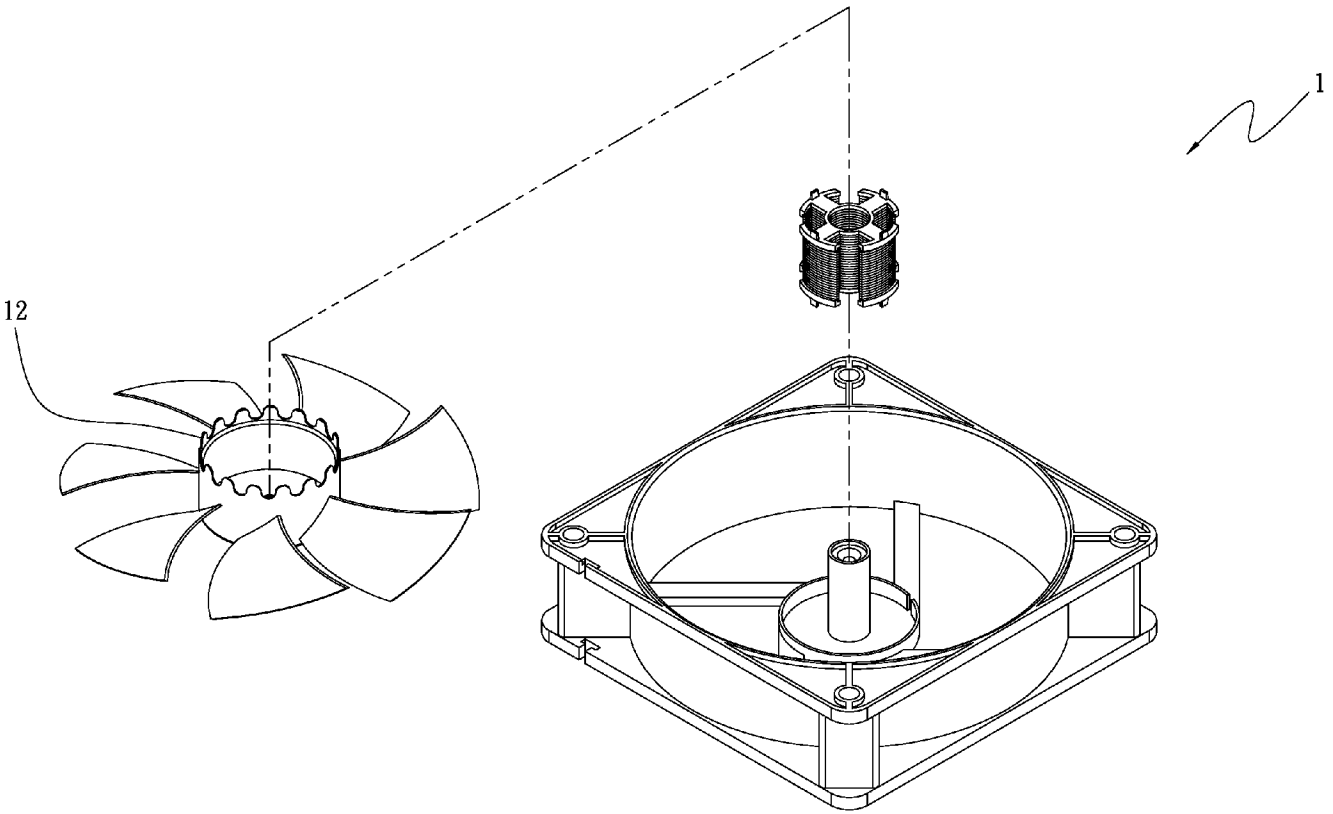
FIG. 6A is an exploded perspective view of a salt-spray protection structure for fan according to a sixth embodiment of the present invention.
Figure 6B:
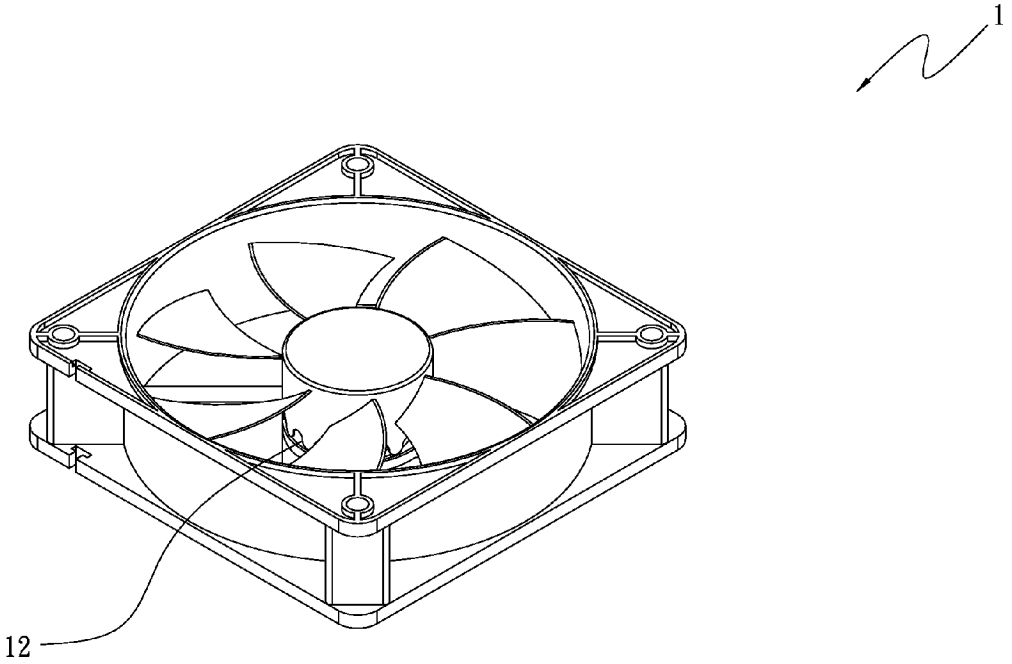
FIG. 6B is an assembled view of FIG. 6A.

FIGS. 5A and 5B are exploded and assembled perspective views, respectively, of a salt-spray protection structure for fan according to a fifth embodiment of the present invention. As shown, the fifth embodiment is generally structurally similar to the previous embodiments, except that the protruded portion 12 includes a semicircular body. FIGS. 6A and 6B are exploded and assembled perspective views, respectively, of a salt-spray protection structure for fan according to a sixth embodiment of the present invention. As shown, the sixth embodiment is generally structurally similar to the previous embodiments, except that the protruded portion 12 is an undulate body.

Compared to the prior art, the salt-spray protection structure for fan according to the present invention has the following advantages: (1) allowing the fan to have extended service life; (2) effectively scraping off undesired accumulated salt grains; and (3) enabling high heat dissipation efficiency of the fan.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A salt-spray protection structure for a fan, comprising:

a frame having an internal volume provided with a base, the base connected to the frame by supporting arms and internally defining a motor stator assembly receiving space having a bearing cup, and the base further having at least one raised surface forming on a circumference of the base to face an impeller rotatably mounted on the base;

the impeller having a hub being rotatably mounted on the base, with a side of the hub facing toward the base having an open end with an end surface thereof facing the at least one raised surface on the base;

at least one protruded portion being forming on one of the at least one raised surface on the base and the end surface of the hub and including a toothed body having a first slant surface facing in a direction of rotation, an opposite second slant surface facing away from the direction of rotation, and a tip formed on upper ends of the first and the second slant surface, the tip being of a shape to scrape off salt grains; and the motor stator assembly including a plurality of silicon steel plates fitted around the bearing cup.

2. The salt-spray protection structure for fan as claimed in claim 1, wherein the hub includes a plurality of blades, and the blades being spaced around the hub.

* * * * *